US006136099A

United States Patent [19]

Akioka et al.

[11] Patent Number: 6,136,099

[45] **Date of Patent: *Oct. 24, 2000**

[54] RARE EARTH-IRON SERIES PERMANENT MAGNETS AND METHOD OF PREPARATION

[75] Inventors: Koji Akioka; Tatsuya Shimoda; Toshiyuki Ishibashi; Ryuichi Ozaki; Osamu Kobayashi, all of Nagano-ken, Japan

[73] Assignee: Seiko Epson Corporation, Tokyo, Japan

[ * ] Notice: This patent is subject to a terminal disclaimer.

[21] Appl. No.: 08/034,009

[22] Filed: Mar. 19, 1993

Related U.S. Application Data

[63] Continuation-in-part of application No. 07/760,555, Sep. 16, 1991, abandoned, which is a continuation-in-part of application No. 07/730,399, Jul. 16, 1991, abandoned, which is a continuation of application No. 07/577,830, Sep. 4, 1990, abandoned, which is a continuation of application No. 07/346,678, May 3, 1989, abandoned, which is a continuation of application No. 06/895,653, Aug. 12, 1986, abandoned, and a continuation-in-part of application No. 07/768,802, Sep. 30, 1992, Pat. No. 5,213,631, which is a division of application No. 07/298,608, Oct. 21, 1988, Pat. No. 5,125,988.

[30] Foreign Application Priority Data

| | | | |
|---|---|---|---|
| Aug. 13, 1985 | [JP] | Japan | 60-178113 |
| Feb. 7, 1986 | [JP] | Japan | 61-25437 |
| Feb. 13, 1986 | [JP] | Japan | 61-29501 |
| Mar. 2, 1987 | [JP] | Japan | 62-047042 |
| Mar. 1, 1988 | [WO] | WIPO | PCT/JP88/00225 |

[51] Int. Cl.[7] ..... H01F 1/057

[52] U.S. Cl. ..... 148/101; 148/120; 148/302

[58] Field of Search ..... 148/101, 102, 148/104, 120, 121, 302; 504/760, 555

[56] References Cited

U.S. PATENT DOCUMENTS

| | | | |
|---|---|---|---|
| 4,475,961 | 10/1984 | Jin | 148/120 |
| 4,767,474 | 8/1988 | Fujimura et al. | 148/302 |
| 4,773,950 | 9/1988 | Fujimura et al. | 148/302 |
| 4,842,656 | 6/1989 | Maines | 148/302 |
| 4,853,045 | 8/1989 | Rozendaal | 148/103 |
| 4,902,361 | 2/1990 | Lee et al. | 148/302 |
| 4,921,551 | 5/1990 | Vernia et al. | 148/101 |
| 4,921,553 | 5/1990 | Tokunaga | 148/302 |
| 4,952,239 | 8/1990 | Tokunaga | 148/302 |
| 4,983,232 | 1/1991 | Endoh | 148/302 |
| 4,985,085 | 1/1991 | Chatterjee | 148/101 |
| 5,049,208 | 9/1991 | Yajima | 148/302 |
| 5,055,142 | 10/1991 | de la Bathie et al. | 148/101 |
| 5,125,988 | 6/1992 | Akioka et al. | 148/101 |
| 5,186,761 | 2/1993 | Kobayashi et al. | 148/101 |
| 5,213,631 | 5/1993 | Akioka et al. | 148/302 |

FOREIGN PATENT DOCUMENTS

| | | |
|---|---|---|
| 0092422 | 10/1983 | European Pat. Off. . |
| 0092423 | 10/1983 | European Pat. Off. . |
| 0101552 | 2/1984 | European Pat. Off. . |

(List continued on next page.)

OTHER PUBLICATIONS

Lee, "Hot–Pressed Neodymium–Iron–Boron Magnets", Appl. Phys. Lett. 46(8), Apr. 15, 1985, pp. 790–791.

Sagawa et al, "New Material for Permanent Magnets on a Base of Nd and Fe (invited)", J. Appl. Phys. 55(6), Mar. 15, 1984, pp. 2083–2087.

(List continued on next page.)

*Primary Examiner*—John Sheehan

*Attorney, Agent, or Firm*—Stroock & Stroock & Lavan LLP

[57] ABSTRACT

A rare earth-iron series magnet formed from an alloy ingot using a one-step hot working process is provided. The alloy ingot includes between about 8 and 30 atomic percent of at least one rare earth element, between about 2 and 28 atomic percent of boron, less than about 50 atomic percent of cobalt, less than about 15 atomic percent of aluminum and the balance of iron and other impurities that are inevitably included during the preparation process. The alloy is cast to obtain a cast ingot and the hot working is performed on the cast ingot at a temperature of greater than about 500° C. in order to make the crystal grains of the ingot fine and to align the axis of the grains in a desired direction.

24 Claims, 2 Drawing Sheets

FOREIGN PATENT DOCUMENTS

| | | | |
|---|---|---|---|
| 0106948 | 5/1984 | European Pat. Off. . | |
| 0108474 | 5/1984 | European Pat. Off. . | |
| 0125752 | 11/1984 | European Pat. Off. . | |
| 0126179 | 11/1984 | European Pat. Off. . | |
| 0133758 | 3/1985 | European Pat. Off. . | |
| 0134304 | 3/1985 | European Pat. Off. . | |
| 0134305 | 3/1985 | European Pat. Off. . | |
| 0144112 | 6/1985 | European Pat. Off. . | |
| 0153744 | 9/1985 | European Pat. Off. . | |
| 0174735 | 3/1986 | European Pat. Off. . | |
| 0187538 | 7/1986 | European Pat. Off. . | |
| 2586323 | 2/1987 | France . | |
| 5647538 | 4/1981 | Japan . | |
| 59132105 | 7/1984 | Japan . | |
| 59-222564 | 12/1984 | Japan . | |
| 6063304 | 4/1985 | Japan . | |
| 61268006 | 5/1985 | Japan . | |
| 60152008 | 8/1985 | Japan . | |
| 60218457 | 11/1985 | Japan . | |
| 61-139603 | 6/1986 | Japan | 148/101 |
| 61119005 | 6/1986 | Japan . | |
| 61-225814 | 10/1986 | Japan . | |
| 61-238915 | 10/1986 | Japan . | |
| 62-47455 | 3/1987 | Japan . | |
| 62-101004 | 5/1987 | Japan . | |
| 62-198103 | 9/1987 | Japan | 148/101 |
| 62-216203 | 9/1987 | Japan . | |
| 63-114106 | 5/1988 | Japan | 148/101 |
| 63-287005 | 11/1988 | Japan | 148/101 |
| 1-171207 | 7/1989 | Japan | 148/101 |
| 1-208811 | 8/1989 | Japan | 148/101 |
| 2-7505 | 1/1990 | Japan | 148/101 |
| 2-101710 | 4/1990 | Japan | 148/101 |
| 2206241 | 12/1988 | United Kingdom | 148/101 |
| WO 80/01857 | 9/1980 | WIPO . | |
| WO-06797 | 9/1988 | WIPO | 148/302 |

OTHER PUBLICATIONS

Chin, "(FeCo)–Nd–B Permanent Magnets By Liquid Dynamic Compaction", J. Appl. Phys. 59(4), Feb. 15, 1986, pp. 1297–1300.

Maocai, "Effects of Additive Elements on Magnetic Properties of Sintered Nd–B–Fe Magnet", Paper No. VIII–5, 8th International Workshop on Rare–Earth Magnets and Their Applications, Dayton,Ohio, May 6–8, 1985, pp. 541–553.

Miho, "Intrinsic Coercivity of Cast–Type Nd–Fe–B Series Alloy Magnet".

Lee, "Hot–Pressed Neodynium–Iron–Boron Magnets", Applied Physics Letters, vol. 46, No. 8, p. 790, Apr. 15, 1985.

L'Heritier, et al., "Magnetisme", Comptes Rendus Acad. Sci. Serie C. Sciences Chimiques, vol. 299, No. 13, pp. 849–852, Nov. 1984.

Cedighian, "Die magnetischen Werkstoffe", VDI Verlag, Dusseldorf, pp. 28–35, 1973.

Koch et al, "Valvo Permanentmagnete I", Verlag Boysen und Maarsch Hamburg, pp. 57–59, 1983.

Chemical Abstracts, Kononenko, et al., "Effect of Heat Treatment on the Coercive Force of Neodymium–Iron–Boron Alloy Magnets", vol. 104, No. 24, p. 705, Jun. 1986.

ROLLING PROCESS

STAMPING PROCESS

RARE EARTH-IRON SERIES PERMANENT MAGNETS AND METHOD OF PREPARATION

CROSS-REFERENCE TO RELATED APPLICATIONS

This application is a continuation-in-part of U.S. application Ser. No. 07/760,555, filed Sep. 16, 1991, now abandoned, which is a continuation-in-part of U.S. application Ser. No. 07/730,399, filed Jul. 16, 1991, now abandoned, which is a continuation of U.S. application Ser. No. 07/577,830, filed Sep. 4, 1990, now abandoned, which is a continuation of U.S. application Ser. No. 07/346,678, filed May 3, 1989, now abandoned, which is a continuation of U.S. application Ser. No. 06/895,653, filed Aug. 12, 1986, now abandoned, and is a continuation-in-part of U.S. application Ser. No. 07/768,802, filed Sep. 30, 1992, now U.S. Pat. No. 5,213,631, which is a division of U.S. application Ser. No. 07/298,608, filed Oct. 21, 1988, now U.S. Pat. No. 5,125,988.

BACKGROUND OF THE INVENTION

This invention relates to rare earth-iron series permanent magnets and, in particular, to an improved method of manufacturing rare earth-iron series permanent magnets and the product produced thereby.

In general, three methods of manufacturing rare earth-iron series permanent magnets are known. These methods include:

1. The sintering method based on powdered metallurgy techniques;
2. The resin bonding technique using rapidly quenched ribbon fragments having thicknesses of about 30$\mu$. The ribbon fragments are prepared using a melt spinning apparatus of the type used for producing amorphous alloys; and
3. The two-step hot pressing technique in which a mechanical alignment treatment is performed on rapidly quenched ribbon fragments. The ribbon fragments are prepared using a melt spinning apparatus.

The sintering method is described in an article by M. Sagawa, S. Fugimara, N. Togawa, H. Yamamoto and Y. Matsura that appeared in Journal of Applied Physics, Vol. 55(6), p. 2083 (Mar. 15, 1984). As described in the article, an alloy ingot is made by melting and casting. The ingot is pulverized to a fine magnetic powder having a particle diameter of about 3$\mu$. The magnetic powder is kneaded with a wax that functions as a molding additive and the kneaded magnetic powder is press molded in a magnetic field in order to obtain a molded body. The molded body, called a "green body", is sintered in an argon atmosphere for one hour at a temperature between about 1000° and 1100° C. and the sintered body is quenched to room temperature. The quenched green body is heat treated at about 600° C. in order to increase further the intrinsic coercivity of the body.

The sintering method requires pulverization of the alloy ingot to a fine powder. However,the R—Fe—B series alloy wherein R is a rare earth element is extremely reactive in the presence of oxygen and therefore the alloy powder is easily oxidized. Accordingly, the oxygen concentration of the sintered body is increased to an undesirable level. When the kneaded magnetic powder is molded, wax or additives such as, for example, zinc stearate are required. While efforts to eliminate the wax or additive are made prior to the sintering process, some of the wax or additive inevitably remains in the magnet in the form of carbon, which deteriorates the magnetic performance of the R—Fe—B alloy magnet.

Following the addition of the wax or molding additive and the press molding, the green or molded body it fragile and difficult to handle. Accordingly, it is difficult to place the green body into a sintering furnace without breakage and this is a major disadvantage of the sintering method.

As a result of these disadvantages, expensive equipment is necessary in order to manufacture R—Fe—B series magnets according to the sintering method. Additionally, productivity is low and manufacturing costs are high. Therefore, the potential benefits of using inexpensive raw materials of the type required are not realized.

The resin bonding technique using rapidly quenched ribbon fragments is described in an article by R. W. Lee that appeared in Applied Physics Letters, Vol. 46(8), p. 790 (Apr. 15, 1985). Ribbon fragments of R—Fe—B alloy are prepared using a melt spinning apparatus spinning at an optimum substrate velocity. The fragments are ribbon shaped, have a thickness of up to 30$\mu$ and are aggregations of grains having a diameter of less than about 1000 Å. The fragments are fragile and magnetically isotropic, because the grains are distributed isotropically. The fragments are crushed to yield particles of a suitable size to form the magnet. The particles are then kneaded with resin and press molded at a pressure of about 7 ton/cm$^2$. Reasonably high densities (85 vol %) are achieved in the resulting magnet.

The vacuum melt spinning apparatus used to prepare the ribbon fragments is expensive and relatively unproductive. The crystals of the resulting magnet are isotropic resulting in a low energy product and a non-square hysteresis loop. Accordingly, the magnet has undesirable temperature coefficients and is impractical.

Alternatively, the rapidly quenched ribbons or ribbon fragments are placed into a graphite or other suitable high temperature die which has been preheated to about 700° C. in vacuum or inert gas atmosphere. When the temperature of the ribbon or ribbon fragments has risen to 700° C., the ribbons or ribbon fragments are subjected to uniaxial pressure. It is to be understood that the temperature is not strictly limited to 700° C., and it has been determined that temperatures in the range of 725° C. ±25° C. and pressures of approximately 1.4ton/cm$^2$ are suitable for obtaining magnets with sufficient plasticity. Once the ribbons or ribbon fragments have been subjected to uniaxial pressure, the grains of the magnet are slightly aligned in the pressing direction, but are generally isotropic.

A second hot pressing process is performed using a die with a larger cross-section. Generally, a pressing temperature of 700° C. and a pressure of 0.7 ton/cm$^2$ are used for a period of several seconds. The thickness of the material is reduced by half of the initial thickness and magnetic alignment is introduced parallel to the press direction. Accordingly, the alloy becomes anisotropic. By using this two-step hot pressing technique, high density anisotropic R—Fe—B series magnets are provided.

In the two-step hot pressing technique, it is preferable to have ribbons or ribbon fragments with grain particle diameters that are slightly smaller than the grain diameter at which maximum intrinsic coercivity would be exhibited. If the grain diameter prior to the procedure is slightly smaller than the optimum diameter, the optimum diameter will be realized when the procedure is completed because the grains are enlarged during the hot pressing procedure.

The two-step hot pressing technique requires the use of the same expensive and relatively unproductive vacuum melt spinning apparatus used to prepare the ribbon fragments for the resin bonding technique. Furthermore, two-step hot working of the ribbon fragments is inefficient even though the procedure itself is unique.

Therefore, it is desirable to provide a method of manufacturing rare earth-iron series permanent magnets that minimizes the disadvantages of the prior art methods.

SUMMARY OF THE INVENTION

Improved rare earth-iron series permanent magnets in accordance with the invention are prepared by melting an alloy ingot, casting the alloy ingot and hot working the ingot at a temperature greater than about 500° C. and at a strain rate of from about $10^{-4}$ to $10^{2}$ per second to make the crystal grains fine and align the axis of the grains in a specific direction. The cast ingot can be heat treated at a temperature greater than about 250° C. in order to harden and strengthen the ingot magnetically either prior to or after hot working. Accordingly, a magnetic, anisotropic cast alloy ingot is obtained without requiring preparation of quenched ribbon fragments or a two-step hot working process. Both latter processes involve production of isotropic fine grains prior to making the magnet anisotropic.

A cast ingot prepared in accordance with the invention can be metal alloy of between about 8 and 30 atomic percent of at least one rare earth element, between about 2 and 28 atomic percent of boron, less than about 50 atomic percent of cobalt, less than about 15 atomic percent of aluminum and less then a boust 6% copper and the balance of iron and other impurities that are inevitably included during the preparation process. Preferably the alloy includes between about 8 and 25 atomic percent of at least one rare earth element, between about 2 and 8 atomic percent boron, less than about 40 atomic percent cobalt, less than about 15 atomic percent aluminum, less than 6% copper and the balance iron and other impurities inevitably included in the preparation process. These alloys have a tetragonal main phase.

Accordingly, it is an object of the invention to provide an improved, high performance rare earth-iron series permanent magnet.

It is another object of the invention to provide a magnetic, anisotropic cast alloy ingot.

It is still another object of the invention to provide an anisotropic magnet wherein the crystals are oriented in a specific direction by hot working.

It is a further object of the invention to provide a rare earth-iron series magnet by an economical process.

It is yet another object of the invention to provide an anisotropic magnet by resin-bonding polycrystals which have been formed from a hot worked alloy ingot by hydrogen decrepitation instead of by mechanical grinding.

It is a further object of the invention to provide an anisotropic rare earth-iron series magnet by a method that does not require quenching or two-step hot working and which does not produce isotropic fine grains prior to production of the anisotropic magnet.

It is a still further object of the invention to provide a relatively inexpensive method of preparing an anisotropic rare-earth iron series permanent magnet by casting an alloy ingot and hot working the cast alloy ingot.

Still other objects and advantages of the invention will in part be obvious and will in part be apparent from the specification.

The invention accordingly comprises the several steps and the relation of one or more of such steps with respect to each of the others, and the article possessing the features, properties and the relation of elements, which are exemplified in the following detailed disclosure, and the scope of the invention will be indicated in the claims.

DESCRIPTION OF THE DRAWINGS

For a fuller understanding of the invention, reference is had to the following description taken in connection with the accompanying drawings, in which.

DETAILED DESCRIPTION OF THE INVENTION

Figure 1:
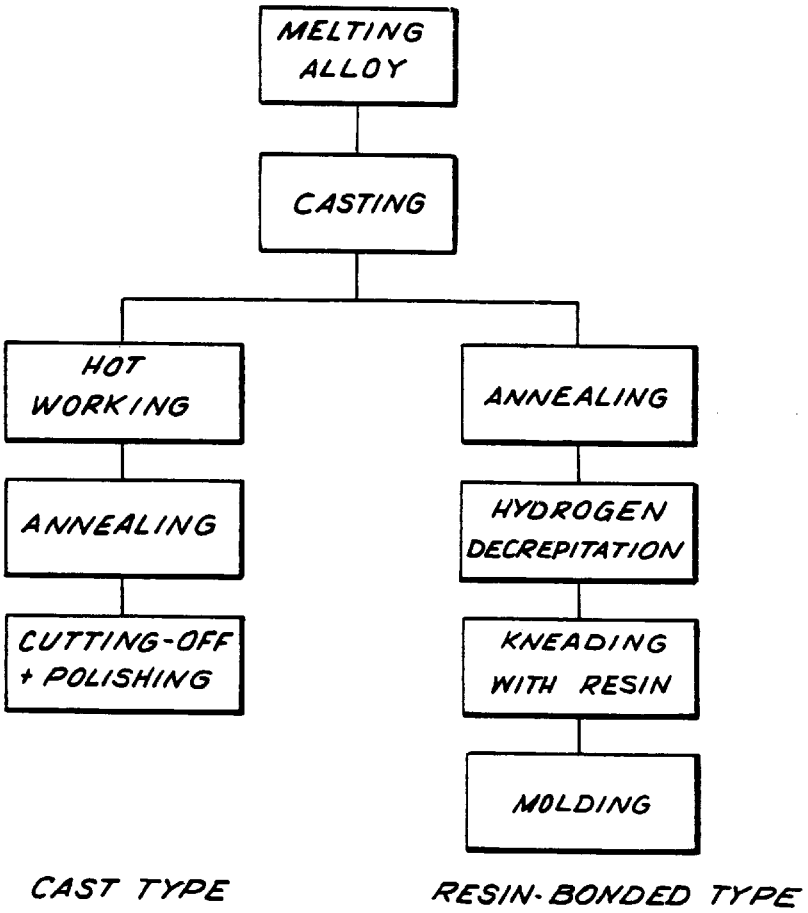
FIG. 1 is a flow diagram showing the steps of the method of manufacturing a rare earth-iron series magnet in accordance with the invention.

Rare earth-iron permanent magnets prepared by a novel preparation method are provided. The magnets can be prepared by melting an alloy of between about 8 and 30 atomic percent of a rare earth element (R), between about 2 and 28 atomic percent of boron (B), less than about 50 atomic percent of cobalt (Co), less than about 15 atomic percent of aluminum (Al) and the balance of iron (Fe) and other impurities that are inevitably included during the preparation process. The alloy can also include copper in an amount up to about 6%. The alloy, which has a tetragonal main phase, is cast to a cast alloy ingot. Hot working is then performed on the cast alloy ingot at a temperature of greater than about 500° C. or above and at a strain rate of from about $10^{-4}$ to $10^{2}$, preferably $10^{-4}$ to 1 per second to obtain fine, crystal grains and to align the grain axis in a desired direction. The cast alloy ingot can be heat treated at a temperature of greater than about 250° C. in order to harden the ingot magnetically either prior to or after hot working. A magnetic, anisotropic cast alloy ingot is obtained.

In order to improve the magnetic properties and increase the intrinsic coercivity of a cast magnet prepared in accordance with the invention, the starting material is preferably a cast magnetic alloy of between about 8 and 25 atomic percent of R, between about 2 and 8 atomic percent of B, less than about 40 atomic percent of Co, less than about 15 atomic percent of Al and a balance of Fe and other impurities that are inevitably included during the preparation process. The cast alloy is hot worked at a temperature of greater than about 500° C. and magnetically hardened by heat treatment at a temperature of greater than about 250° C.

The rare earth element (R) in the alloy composition is one or more elements selected from yttrium (Y), lanthanum (La), cerium (Ce), praseodymium (Pr), neodymium (Nd), samarium (Sm), europium (Eu), gadolinium (Gd), terbium (Tb), dysprosium (Dy), molybdenum (Mo), erbium (Er), thulium (Tm), ytterbium (Yb) and lutetium (Lu). The best magnetic performance is obtained when Pr is selected. For practical purposes, Pr, Pr—Nd alloy, Ce—Pr—Nd alloy and the like are commonly used.

Small amounts of additive elements can also be included. Such additive elements can be heavy rare earth elements such as dysprosium (Dy) and terbium (Tb) or, alternatively, elements such as aluminum (Al), molybdenum (Mo), silicon (Si) and the like. The additive elements serve to enhance the intrinsic coercivity of the composition.

The main phase of the R—Fe—B series magnet is $R_2Fe_{14}B$. When R is less than about 8 atomic percent, the tetragonal $R_2Fe_{14}B$ compound does not emerge. In such a case, a body centered cubic having the same structure as α-iron emerges and good magnetic properties are not obtained. In contrast, when R is greater than about 30 atomic percent, the number of non-magnetic R-rich phases increases and magnetic properties are deteriorated significantly. Accordingly, a suitable range of the amount of R is between about 8 and 30 atomic percent. In the case of a cast magnet the range of R is more preferably between about 8 and 25 atomic percent.

Boron (B) is the essential element that causes the tetragonal $R_2Fe_{14}B$ phase to emerge. If less than about 2 atomic percent of B is used, the rhombohedral R—Fe series does not emerge and high intrinsic coercivity is not obtained. However, as shown in magnets produced by sintering methods of the prior art, if B is included in an amount greater than about 28 atomic percent, non-magnetic B-rich phases increase and the residual magnetic flux density is reduced. Accordingly, the upper limit of the desirable amount of B for sintered magnets is about 28 atomic percent. If B is greater than about 8 atomic percent, however, a fine $R_2Fe_{14}$ B phase is not obtained unless specific cooling is performed and, even in this case, intrinsic coercivity is low. Accordingly, B is more preferably in the range between about 2 and 8 atomic percent, especially when the alloy is to be used to prepare a cast magnet.

Cobalt (Co) is effective to enhance the Curie point and can be substituted at the site of the Fe element to produce $R_2Co_{14}B$. However, the $R_2Co_{14}$ B compound has a small crystalline anisotropic field. The greater the quantity of the $R_2Co_{14}$ B compound, the lower the intrinsic coercivity of the magnet. Accordingly, in order to obtain a coercivity of greater than about 1kOe, which is considered sufficient for a permanent magnet, Co should be present in an amount less than about 50 atomic percent.

Aluminum (Al) increases the intrinsic coercivity of the resulting magnet. This effect is described in Zhang Maocai, et al., Proceedings of the 8th International Workshop on Rare-Earth Magnets, p. 541 (1985). The Zhang Maocai, et al. reference refers only to the effect of aluminum in sintered magnets. However, the same effect is observed in cast magnets.

Since aluminum is a non-magnetic element, if the amount of aluminum is large, the residual magnetic flux density decreases to an unacceptable level. If more than about 15 atomic percent of aluminum is used, the residual magnetic flux density is reduced to the level of hard ferrite. Accordingly, a high performance rare-earth magnet is not achieved. Therefore, the amount of aluminum should be less than about 15 atomic percent.

The amount of iron (Fe), the main constituent, should be between about 42 and 90 atomic percent. If the amount of Fe is less than about 42 atomic percent, the residual magnetic flux density is lowered to an unacceptable level. On the other hand, if the amount of iron is greater than about 90 atomic percent, high intrinsic coercivity is not observed.

Copper increases the energy product and coercive force of the magnet. It also changes the structure of the alloy after casting and hot working as follows:

1) The crystal grains are refined at casting;
2) A uniform structure is formed after working which is associated with improved workability and a broadened range of strain rates at which the alloy can be hot worked; and
3) The columnar structure of the magnet is improved.

However, Cu is a non-magnetic element. Thus, it lowers the residual flux density and should be present only in a minimum effective amount which is sufficient to increase the energy product, coercive force or strain rate of the magnetic material without unacceptably affecting the flux density. About 6% Cu is a preferred maximum and about 0.1 to 3% Cu is a preferred range. As shown in the Examples, a range of 1.5 to 4% copper can also be effective.

As discussed hereinabove, each of the prior art methods for preparing a rare earth-iron series permanent magnet has disadvantages. For example, in the sintering method it is difficult to handle the powder, while in the resin-bonding technique using quenched ribbon fragments, productivity is poor. In order to eliminate these disadvantages, magnetic hardening in the bulk state has been studied with the following conclusions:

1. A fine grain, anisotropic alloy can be prepared by hot working an alloy composition consisting of between about 8 and 30 atomic percent of R, between about 2 and 28 atomic percent of B, less than about 50 atomic percent of Co, less than about 15 atomic percent of Al and the balance of Fe and other impurities that are inevitably included during the preparation process.
2. A magnet with sufficient intrinsic coercivity is obtained by heat treating a cast ingot having an alloy composition containing between about 8 and 25 atomic percent of R, between about 2 and 8 atomic percent of B, less than about 50 atomic percent of Co, less than about 15 atomic percent of Al and the balance of Fe and other impurities that are inevitably included during the preparation process.
3. An anisotropic resin-bonded magnet can be obtained by pulverizing a hot worked cast ingot consisting of between about 8 and 25 atomic percent of R, between about 2 and 8 atomic percent of B, less than about 50 atomic percent of Co, less than about 15 atomic percent of Al and the balance of Fe and other impurities that are inevitably included during the preparation process to powders using hydrogen decrepitation, kneading the powders with an organic binder and curing the kneaded powder and binder.
4. Anisotropic resin-bonded magnets can be obtained after hot working is performed because the pulverized powders have a plurality of anisotropic fine grains. Accordingly, the ingot is formed of a plurality of anisotropic fine grains.

In accordance with the invention, hot working a cast alloy ingot at a temperature of about 500° C. and above and at a strain rate of from about $10^{-4}$ to $10^{2}$, preferably $10^{-4}$ to 1 per second to make the ingot anisotropic can be accomplished in only one step, in contrast to the two-step hot working procedure described in the Lee reference. Furthermore, the intrinsic coercivity of the hot worked body is increased as a result of the fineness of the grains. Since there is no need to pulverize the cast ingot it is not necessary to control the sintering atmosphere strictly and this greatly reduces equipment cost and increases productivity. Another advantage of the hot working method in accordance with the invention is that the resin-bonded magnets are not originally isotropic, as is the case with magnets obtained by the usual quenching methods. Accordingly, an anisotropic resin bonded magnet is easily obtained and the advantages of a high performance, low cost R—Fe—B series magnet are realized.

A report on the magnetization of alloys in the bulk state was presented by Hiroaki Miho, et al. at the lecture meeting of the Japanese Institute of Metals, Autumn 1985, Lecture No. 544. The report refers to small samples having the composition $Nd_{16.2}Fe_{50.7}Co_{22.6}V_{1.3}B_{9.2}$, which is a different alloy composition range from that in accordance with the invention. The composition is melted in air during exposure to an argon gas spray and is then extracted for sampling. The sample alloy grains were quenched and became fine as a result of the quenching. After studying this report, applicants are of the opinion that this fine grain was observed because of the small size of the samples taken.

It has also been determined experimentally that grains of the main phase $Nd_2Fe_{14}B$ became course when they were cast according to an ordinary casting method. Although it is possible to make an alloy of the composition $Nd_{16.2}Fe_{50.7}Co_{22.6}V_{1.3}B_{9.2}$, anisotropic by hot working, it is difficult to obtain sufficient intrinsic coercivity of the resulting body for use as a permanent magnet.

It has also been determined that in order to obtain a magnet of sufficient intrinsic coercivity by ordinary casting methods, the composition of the starting material should be a B-poor composition. A suitable B-poor alloy composition has between about 8 and 25 atomic percent of R, between about 2 and 8 atomic percent of B, less than about 50 atomic percent of Co, less than about 15 atomic percent of Al and the balance of Fe and other inevitable impurities.

The typical optimum composition of the R—Fe—B series magnet in the prior art is believed to be $R_{15}Fe_{77}B_8$ as shown in the Sagawa, et al. reference. R and B are richer in this composition than in the composition of $R_{11.7}Fe_{82.4}B_{5.9}$, which is the equivalent in atomic percentage to the $R_2Fe_{14}B$ main phase of the alloy. This is explained by the fact that in order to obtain sufficient intrinsic coercivity, non-magnetic R-rich and B-rich phases are necessary in addition to the main phase.

In the B-poor composition having between about 8 and 25 atomic percent of R, between about 2 and 8 atomic percent of B, less than about 50 atomic percent of Co, less than about 15 atomic percent of Al and the balance of Fe and other impurities which are inevitably included during the preparation process, the intrinsic coercivity is at a maximum when B is poorer than in ordinary compositions. Generally, such B-poor compositions exhibit a large decrease in intrinsic coercivity when a sintering method is used. Accordingly, this composition region has not been extensively studied.

When ordinary casting methods are used, high intrinsic coercivity is obtained only in the B-poor composition region. In the B-rich composition, which is the main composition region for use in the sintering method, sufficient intrinsic coercivity is not observed.

The reason that the B-poor composition region is desirable is that when either a sintering or a casting method is used to prepare magnets in accordance with the invention, the intrinsic coercivity mechanism of the magnet arises primarily in accordance with the nucleation model. This is established by the fact that the initial magnetization curves of the magnets prepared by either method show steep rises such as, for example, the curves of conventional $SmCo_5$ type magnets. Magnets of this type have intrinsic coercivity in accordance with the single domain model. Specifically, if the grain of an $R_2Fe_{14}B$ alloy having large crystal magnetic anisotropy is too large, magnetic domain walls are introduced in the grain. The movement of the magnetic domain walls causes reverse magnetism to be easily inverted, thereby decreasing the intrinsic coercivity. On the other hand, if the grain of $R_2Fe_{14}B$ is smaller than a specific size, magnetic walls disappear from the grain. In this case, since the magnetism can be reversed only by rotation of the magnetization, the intrinsic coercivity is decreased.

In order to obtain sufficient coercivity, the $R_2Fe_{14}B$ phase is required to have an adequate grain diameter, specifically about $10\mu$. When the sintering method is used, the grain diameter can be adjusted by adjusting the powder diameter prior to sintering. However, when a resin-bonding-technique is used, the grain diameter of the $R_2Fe_{14}B$ compound is determined when the molten alloy solidifies. Accordingly, it is necessary to control the composition and solidification process carefully.

The composition of the alloy is particularly important. If more than 8 atomic percent of B is included, it is extremely likely that the grains of the $R_2Fe_{14}B$ phase in the magnet after casting will be larger than $100\mu$. Accordingly, it is difficult to obtain sufficient intrinsic coercivity in the cast state without using quenched ribbon fragments of the type shown in the Lee, et al. reference. In contrast, when a B-poor composition is used, the grain diameter can be reduced by adjusting the type of mold, molding temperature and the like. In either case, the grains of the main phase $R_2Fe_{14}B$ can be made finer by performing a hot working step and accordingly, the intrinsic coercivity of the magnet is increased.

The alloy composition ranges in which sufficient intrinsic coercivity is observed in the cast state, specifically, the B-poor composition can also be referred to as the Fe-rich composition. In the solidifying state, Fe first appears as the primary phase and then $R_2Fe_{14}B$ appears as a result of the peritectic reaction. Since the cooling speed is much greater than the speed of the equilibrium reaction, the sample is solidified in such a way that the $R_2Fe_{14}B$ phase surrounds the primary Fe phase. Since the composition region is B-poor, the B-rich phase of the type seen in the $R_{15}Fe_{77}B_8$ magnet, which is a typical composition suitable for the sintering method, is small enough to be of no consequence. The heat treatment of the B-poor alloy ingot causes the primary Fe phase to diffuse and an equilibrium state to be achieved. The intrinsic coercivity of the resulting magnet depends to a great extent on iron diffusion.

A resin-bonded magnet prepared by resin-bonding quenched ribbon fragments is shown in the Lee reference. However, since the powder obtained using the quenching method consists of an isotropic aggregation of polycrystals having a diameter of less than about 1000 Å, the powder is magnetically isotropic. Accordingly, an anisotropic magnet cannot be obtained and the low cost, high performance advantages of the R—Fe—B series magnet cannot be achieved using the technique of resin-bonding quenched ribbon fragments.

When the R—Fe—B series resin-bonded magnet is prepared in accordance with the invention, the intrinsic coercivity is maintained at a sufficiently high level by pulverizing the hot worked cast alloy ingot to fine particles by hydrogen decrepitation. Hydrogen decrepitation causes minimal mechanical distortion and accordingly, resin-bonding can be achieved. The greatest advantage of this method is that an anisotropic magnet can be prepared by resin-bonding grains that are initially anisotropic.

When the alloy composition is pulverized to fine particles by hydrogen decrepitation, hydrogenated compounds are produced due to the particular alloy composition employed. The pulverized anisotropic fine particles are kneaded with an organic binder and cured to obtain the anisotropic resin-bonded magnet.

In order to obtain a resin bonded magnet by pulverizing an alloy ingot, the alloy ingot should be one wherein the grain size can be made fine by hot working. It is to be understood that each grain of the powder includes a plurality of magnetic $R_2Fe_{14}B$ grains even after pulverization, kneading with an organic binder and curing to obtain a resin bonded magnet.

There are two reasons why a resin-bonded R—Fe—B series magnet can be prepared only by performing a pulverizing step in accordance with the invention. First, the critical radius of the single domain of the $R_2Fe_{14}B$ compound is significantly smaller than that of the $SmCo_5$ alloy used to prepare prior art samarium-cobalt magnets and the like and is on the order of submicrons. Accordingly, it is extremely difficult to pulverize material to such small grain diameters by ordinary mechanical pulverization. Furthermore, the powder obtained is activated easily and consequently is easily oxidized and ignited. Therefore, the intrinsic coercivity of the resulting magnet is low in comparison to the grain diameter. The relationship between grain diameter and intrinsic coercivity was studied and it was determined that intrinsic coercivity was a few kOe at most even in very small gain sizes and did not increase even when surface treatment of the magnet was performed.

A second problem is distortion caused by mechanical working. For example, if a magnet having an intrinsic coercivity of 10 kOe in the sintered state is pulverized mechanically, the resulting powder having a grain diameter of between about 20 and 30$\mu$ possesses coercivity as low as 1 kOe or less. In the case of mechanically pulverizing $SmCo_5$ magnet of the type that is considered to have a similar mechanism of coercivity (nucleation model), such a decrease in the intrinsic coercivity does not occur and a powder having sufficient coercivity is easily prepared. This phenomenon arises because the effect of distortion and the like caused by the pulverization and working of the R—Fe—B series magnet is much greater. This presents a critical problem in the case of a small magnet such as a rotor magnet of a step motor for a watch that is cut from a sintered magnetic block.

For the reasons set out above, specifically, the critical radius is small and the effect of mechanical distortion is large, resin-bonded magnets cannot be obtained by ordinary pulverization of normal cast alloy ingots or sintered magnetic blocks. In order to obtain powder having sufficient intrinsic coercivity, the powder grains should include a plurality of $R_2Fe_{14}B$ grains as disclosed in the Lee reference. However, the resin-bonding technique of quenched ribbon fragments is not a productive process because of the production of isotropic grains. Furthermore, it is not possible to prepare a powder of this type by pulverization of a sintered body because the grains become larger during sintering and it is necessary to make the grain diameter prior to sintering smaller than the desired grain diameter. However, if the grain diameter is too small, the oxygen concentration will be extremely high and the performance of the magnet will be far from satisfactory. At present, the permissible grain diameter of the $R_2Fe_{14}B$ compound after sintering is about 10$\mu$. However, the intrinsic coercivity is reduced to almost zero after pulverization.

Preparation of fine grains by hot working has also been observed. It is relatively easy to make $R_2Fe_{14}B$ compound in the molded state having a grain size of about the same size as that prepared by sintering. By performing hot working on a cast alloy ingot having an $R_2Fe_{14}B$ phase having a grain size on the order of the grain size prepared by sintering, the grains can be made fine, aligned and then pulverized. Since the grain diameter of the powder for the resin-bonded magnet is between about 20 and 30$\mu$, it is possible to include a plurality of $R_2Fe_{14}B$ grains in the powder. This provides a powder having sufficient intrinsic coercivity. Furthermore, the powders obtained are not isotropic like the quenched ribbon fragments prepared in accordance with the Lee reference, and can be aligned in a magnetic field and an anisotropic magnet can be prepared. If the anisotropic grains are pulverized using hydrogen decrepitation, the intrinsic coercivity is maintained even better.

The invention will be better understood with reference to the following examples. These examples are presented for purposes of illustration only and are not intended to be construed in a limiting sense.

EXAMPLE 1

Reference is made to FIG. 1 which is a flow diagram showing alternate methods of manufacturing a permanent magnet in accordance with the invention. Alloys of the desired composition were melted in an induction furnace and cast into dies. Various types of hot working were performed on the samples in order to provide anisotropy to the magnets. The Liquid Cynamic Compaction method described in T. S. Chin, et al., Journal of Applied Physics, 59(4), p. 1297 (Feb.15, 1986) was used in place of a general molding method and had the effect of making the crystal grains fine as if the samples had been quenched.

Figure 2:
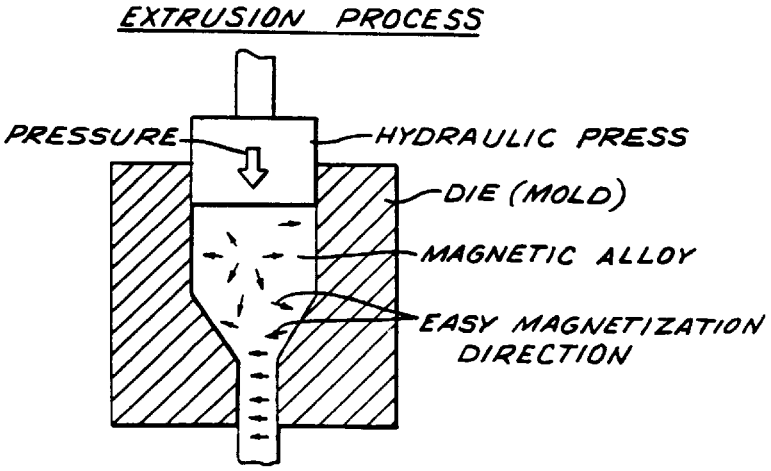
FIG. 2 is a schematic diagram showing anisotropic alignment of the magnetic cast alloy ingot by extrusion.
Figure 3:
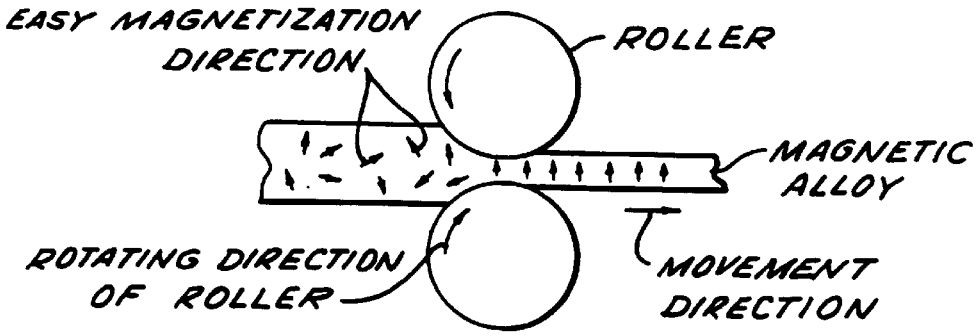
FIG. 3 is a schematic diagram showing anisotropic alignment of the magnetic alloy by rolling.
Figure 4:
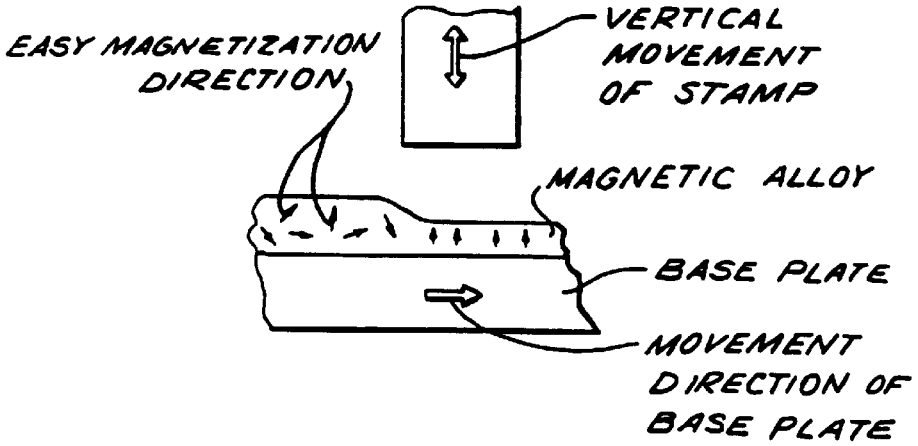
FIG. 4 is a schematic diagram showing anisotropic alignment of a magnetic cast alloy ingot by stamping.

Hot working was performed by extrusion as shown in FIG. 2, rolling as shown in FIG. 3 or stamping as shown in FIG. 4. Hot working was carried at temperatures between about 700° C. and 800°C.

In the case of extrusion, a means for applying pressure on the side of the die was provided in order to provide isotactic pressure to the sample. In the case of rolling and stamping, the speed of rolling or stamping was adjusted to minimize the strain rate. The "strain rate" refers to the value of the degree of logarithmic strain per unit time and is represented by the equality:

$$\text{Strain rate}=dE/dt,$$

wherein E is the logarithmic strain and t is time.

Logarithmic strain, E, is defined by the equality:

$$E=l_n(l_2/l_1),$$

wherein ln is the natural log, $l_2$ is the length after processing and l1 is the length before processing. The easy axis magnetization of the grains was aligned parallel to the direction in which the alloy was urged independent of the type of hot working used.

Alloys having the compositions shown in Table 1 were melted, cast and made into magnets by the hot working methods shown.

TABLE 1

| No. | composition | hot working |
|---|---|---|
| 1 | $Nd_8\ Fe_{84}\ B_8$ | extrusion |
| 2 | $N_{15}\ Fe_{77}\ B_8$ | rolling |
| 3 | $Nd_{22}\ Fe_{70}\ B_8$ | stamping |
| 4 | $Nd_{30}\ Fe_{58}\ B_{12}$ | extrusion |
| 5 | $Ce_{3.4}\ Nd_{8.5}\ Pr_{7.1}\ Fe_{75}\ B_6$ | rolling |
| 6 | $Nd_{17}\ Fe_{60}\ Co_{17}\ B_6$ | stamping |
| 7 | $Nd_{17}\ Fe_{60}\ Co_{15}\ V_2\ B_6$ | extrusion |
| 8 | $Ce_4\ Nd_9\ Pr_6\ Fe_{55}\ Co_{15}\ Al_5\ B_6$ | rolling |
| 9 | $Ce_3\ Nd_{10}\ Pr_8\ Fe_{52}\ Co_{15}\ Mo_4\ B_8$ | stamping |
| 10 | $Ce_3\ Nd_{10}\ Pr_8\ Fe_{52}\ Co_{17}\ Nb_2\ B_8$ | extrusion |
| 11 | $Ce_3\ Nd_6\ Pr_{10}\ Fe_{54}\ Co_{17}\ Ta_2\ B_8$ | rolling |
| 12 | $Ce_3\ Nd_6\ Pr_8\ Fe_{50}\ Co_{19}\ Ti_2\ B_{12}$ | stamping |
| 13 | $Ce_3\ Nd_{10}\ Pr_6\ Fe_{50}\ Co_{15}\ Zr_2\ B_{14}$ | extrusion |
| 14 | $Ce_3\ Nd_{10}\ Pr_6\ Fe_{56}\ Co_{15}\ Hf_2\ B_8$ | rolling |

Hot working was performed at a controlled temperature of 1000° C., the strain rate varied between $10^{-3}$ and $10^{-2}$ degrees per second and the ratio of reduction was 80%. The ratio of reduction is the value of the degree of plastic deformation of the sample due to processing and is defined by the equality:

Ratio of reduction=(( $d_1-d_2$)/$d_1$)×100%, wherein $d_1$ is the thickness before processing and $d_2$ is the thickness after processing. Depending on the form of the sample or the processing method, cross-sectional area or diameter can be used to define $d_1$ and $d_2$ in lieu of thickness. Annealing was performed after hot working for 24 hours at a temperature of 1000° C.

The properties of the resulting magnets are shown in Table 2. For purposes of comparison, residual magnetic flux densities of cast ingots on which hot working was not performed are also shown.

TABLE 2

| | after hot working | | | after casting | |
|---|---|---|---|---|---|
| No. | Br(KG) | bHc(MGOe) | (BH)max (MGOe) | Br(KG) | (BH)max(MGOe) |
| 1 | 9.3 | 2.6 | 5.7 | 0.8 | 0.1 |
| 2 | 9.7 | 3.4 | 4.9 | 1.3 | 0.3 |
| 3 | 8.5 | 2.9 | 6.4 | 1.7 | 0.5 |
| 4 | 6.4 | 4.5 | 5.1 | 1.3 | 0.2 |
| 5 | 10.6 | 3.8 | 5.6 | 1.2 | 0.3 |
| 6 | 11.3 | 3.9 | 5.8 | 1.4 | 0.4 |
| 7 | 11.9 | 10.7 | 30.1 | 6.1 | 2.3 |
| 8 | 11.3 | 10.7 | 27.5 | 6.1 | 1.9 |
| 9 | 11.5 | 10.2 | 28.3 | 6.0 | 1.6 |
| 10 | 9.2 | 6.9 | 15.3 | 5.5 | 2.5 |
| 11 | 9.6 | 7.1 | 13.2 | 4.7 | 3.2 |
| 12 | 9.1 | 6.0 | 11.3 | 4.9 | 2.1 |
| 13 | 7.7 | 5.6 | 8.2 | 5.1 | 1.9 |
| 14 | 8.7 | 7.1 | 15.1 | 6.2 | 3.1 |

The characteristics defined in Table 2 and in the following Tables are as follows.

"Br" is the magnetic flux density or magnetic induction, a vector quantity used as a quantitative measure of magnetic field. The force acting on a charged particle moving in a magnetic field is equal to the particle's charge times the cross product of the particles velocity with the magnetic induction, Br.

"iHC" is the coercive force and represents the magnetic field, H, which must be applied to a magnetic material in a symmetrical cyclicly magnetized fashion, to make the magnetic induction, Br, vanish.

"(BH)max" is the maximum value of the energy product curve obtained by plotting the product of the values of magnetic induction, Br, and demagnetizing force, H, as function of the demagnetization curve of a permanent magnet material.

As can be seen from the results in Table 2, all the hot working techniques i.e., extrusion, rolling and stamping, increased the residual magnetic flux density of the alloy ingot and caused the samples to become magnetically anisotropic. The values of (BH)max were also increased by hot working.

EXAMPLE 2

This Example illustrates the general casting method utilized in accordance with the invention. Alloys having the compositions shown in Table 3 were melted in an induction furnace and cast into an iron die.

TABLE 3

| No. | composition |
|---|---|
| 1 | $Pr_{10}Fe_{86}B_4$ |
| 2 | $Pr_{16}Fe_{80}B_4$ |
| 3 | $Pr_{22}Fe_{74}B_4$ |
| 4 | $Pr_{26}Fe_{70}B_4$ |
| 5 | $Pr_{13}Fe_{85}B_2$ |
| 6 | $Pr_{13}Fe_{81}B_6$ |
| 7 | $Pr_{13}Fe_{79}B_8$ |
| 8 | $Pr_{12}Fe_{74}Co_{10}B_4$ |
| 9 | $Pr_{12}Fe_{59}Co_{25}B_4$ |
| 10 | $Pr_{13}Fe_{43}Co_{40}B_4$ |
| 11 | $Pr_{13}Dy_3Fe_{80}B_4$ |
| 12 | $Pr_{16}Fe_{78}B_4Si_2$ |
| 13 | $Pr_{16}Fe_{76}Al_4B_4$ |
| 14 | $Pr_{16}Fe_{76}Mo_4B_4$ |
| 15 | $Nd_{14}Fe_{78}P_4B_4$ |
| 16 | $Ce_3Nd_3Pr_{10}Fe_{80}B_4$ |
| 17 | $Nd_{12}Fe_{80}Al_4B_4$ |

Hot pressing was performed on the cast alloy ingots at 1000° C. The strain rate was controlled at between about $10^{-3}$ and $10^{-2}$ second and the ratio of reduction was 80%. An annealing treatment was performed on the pressed ingots for 24 hours at 1000° C. to magnetically harden the ingots.

Resin bonded magnets were also prepared using the other cast alloy ingots having the same compositions. The cast ingots were annealed at between about 400° and 1050° C. to magnetically harden the ingots, but no hot working was performed prior to annealing. The annealed ingots were crushed to a fine powder by repeated hydrogen absorption in a hydrogen atmosphere at a pressure of about 10 atm and hydrogen desorption at a pressure of about $10^{-5}$ torr in an 18-8 stainless steel container at room temperature. The pulverized samples and the kneaded pulverized samples were kneaded with about 4 weight percent of epoxy resin were molded in a magnetic field of 10 kOe applied perpendicular to the pressing direction. The magnetic properties of the hot worked and resin-bonded magnets are shown in table Table 4.

TABLE 4

| | hot working type | | resin-bonded type | |
|---|---|---|---|---|
| No. | iHc(KOe) | (BH)max(MGOe) | iHc(KOe) | (BH)max(MGOe) |
| 1 | 6.1 | 9.8 | 4.9 | 5.9 |
| 2 | 15.3 | 21.1 | 12.0 | 17.6 |
| 3 | 11.7 | 17.5 | 9.4 | 9.8 |
| 4 | 10.2 | 11.0 | 8.2 | 5.6 |
| 5 | 4.1 | 3.0 | 3.0 | 1.8 |
| 6 | 12.0 | 21.5 | 9.0 | 14.2 |
| 7 | 6.1 | 2.2 | 4.7 | 11.3 |
| 8 | 13.1 | 25.8 | 10.5 | 16.8 |
| 9 | 7.5 | 16.2 | 6.2 | 9.7 |
| 10 | 3.6 | 12.8 | 2.9 | 7.7 |
| 11 | 18.0 | 26.8 | 13.4 | 17.4 |
| 12 | 15.9 | 24.5 | 12.5 | 16.2 |
| 13 | 16.4 | 25.4 | 13.0 | 16.5 |
| 14 | 16.6 | 25.1 | 13.3 | 17.1 |
| 15 | 9.6 | 12.5 | 7.5 | 10.3 |
| 16 | 11.6 | 15.0 | 9.3 | 13.5 |
| 17 | 16.7 | 21.1 | 13.5 | 14.9 |

In the case of the cast type magnet, (BH)max and iHc are greatly increased by hot working. This is due to the fact that the grains are aligned and the squareness of the BH curve is improved significantly. By resin-bonding quenched ribbon fragments as shown in the Lee reference, iHc tends to be lowered by hot working. Accordingly, it is a significant advantage of the invention that intrinsic coercivity is improved by hot working.

EXAMPLE 3

An anisotropic cast alloy ingot was prepared by a process comprising the steps of melting an alloy composition, casting the composition to obtain an ingot, hot working the ingot at a temperature greater than about 500° C., annealing the hot worked ingot at a temperature between about 400° and 1050° C. and cutting and polishing the ingot. The alloys of the compositions shown in Table 5 were melted in an induction furnace and cast. Hot working was performed on the cast ingot in order to make the magnet anisotropic. The hot working was either extrusion as shown in FIG. 2, rolling as shown in FIG. 3 or stamping as shown in FIG. 4. The type of hot working is also shown in Table 5.

TABLE 5

| No. | composition | hot working |
|---|---|---|
| 1 | $Pr_8 Fe_{29} B_4$ | rolling |
| 2 | $Pr_{14} Fe_{32} B_4$ | " |
| 3 | $Pr_{20} Fe_{76} B_4$ | " |
| 4 | $Pr_{25} Fe_{71} B_4$ | " |
| 5 | $Pr_{14} Fe_{24} B_2$ | " |
| 6 | $Pr_{16} Fe_{20} B_4$ | " |
| 7 | $Pr_{14} Fe_{78} B_8$ | " |
| 8 | $Pr_{14} Fe_{78} Co_{10} B_4$ | excrusion |
| 9 | $Pr_{13} Dy_2 Fe_{81} B_4$ | " |
| 10 | $Pr_{14} Fe_{20} B_4 Si_2$ | " |
| 11 | $Pr_{14} Fe_{78} Al_4 B_4$ | " |
| 12 | $Pr_{14} Fe_{78} Mo_4 B_4$ | " |
| 13 | $Nd_{14} Fe_{91} B_4$ | stamping |
| 14 | $Ce_3 Nd_3 Pr_8 Fe_{22} B_4$ | " |
| 15 | $Nd_{14} Fe_{78} Al_4 B_4$ | " |

Hot working was performed at a temperature between about 700° and 800° C. and annealing was performed at a temperature of 1000° C. for a period of 24 hours. The easy axis of magnetization of the grain was aligned parallel to the pressing direction regardless of the hot working process that was used. The magnetic properties of the magnets are shown in Table 6.

TABLE 6

| | hot working performed | | | no hot working | |
|---|---|---|---|---|---|
| No. | Br(KG) | iHc(kOe) | (BH)max(MGOe) | Br(KG) | (BH)max(MGOe) |
| 1 | 9.4 | 2.5 | 5.0 | 3.8 | 1.7 |
| 2 | 11.0 | 10.0 | 28.5 | 6.0 | 6.5 |
| 3 | 9.8 | 7.3 | 18.1 | 5.1 | 4.7 |
| 4 | 8.0 | 6.2 | 15.0 | 4.4 | 2.8 |
| 5 | 5.5 | 1.6 | 5.9 | 4.4 | 2.0 |
| 6 | 10.2 | 5.5 | 23.7 | 6.2 | 6.2 |
| 7 | 7.8 | 1.2 | 6.5 | 4.6 | 2.3 |
| 8 | 10.5 | 8.1 | 27.4 | 6.0 | 6.0 |
| 9 | 10.7 | 12.0 | 26.2 | 6.4 | 7.0 |
| 10 | 10.8 | 10.6 | 28.3 | 6.1 | 6.0 |
| 11 | 10.5 | 11.8 | 25.0 | 6.3 | 7.1 |
| 12 | 10.4 | 11.6 | 24.8 | 6.5 | 6.9 |
| 13 | 9.5 | 6.2 | 17.4 | 6.4 | 6.4 |
| 14 | 9.9 | 7.3 | 18.7 | 6.4 | 6.4 |
| 15 | 10.5 | 10.4 | 24.2 | 6.5 | 6.9 |

EXAMPLE 4

An anisotropic resin-bonded alloy ingot was prepared by process comprising the steps of melting an alloy, casting the alloy to perform an ingot, hot working the ingot at a temperature above about 500° C., annealing the ingot at a temperature between about 400° and 1050° C., pulverizing the annealed ingot by hydrogen decrepitation, kneading the pulverized ingot with an organic binder, molding the kneaded powder in magnetic field and curing the magnet. The alloys showing 7 were melted in an induction furnace.

TABLE 7

| No. | composition |
|---|---|
| 1 | $Pr_8 Fe_{88} B_4$ |
| 2 | $Pr_{14} Fe_{82} B_4$ |
| 3 | $Pr_{20} Fe_{74} B_4$ |
| 4 | $Pr_{25} Fe_{71} B_4$ |
| 5 | $Pr_{14} Fe_{84} B_2$ |
| 6 | $Pr_{14} Fe_{80} B_6$ |
| 7 | $Pr_{14} Fe_{78} B_8$ |
| 8 | $Pr_{14} Fe_{72} Co_{10} B_4$ |
| 9 | $Pr_{13} Dy_2 Fe_{81} B_4$ |
| 10 | $Pr_{14} Fe_{80} B_4 Si_2$ |
| 11 | $Pr_{14} Fe_{78} Al_4 B_4$ |
| 12 | $Pr_{14} Fe_{78} Mo_4 B_4$ |
| 13 | $Nd_{14} Fe_{82} B_4$ |
| 14 | $Ce_3 Nd_3 Pr_8 Fe_{82} B_4$ |
| 15 | $Nd_{14} Fe_{78} Al_4 B_4$ |

The molten alloys were cast in a mold and the cast ingot was annealed at a temperature between about 400° and 1050° C. in order to magnetically harden the ingot. Annealing was performed at 1000° C. for 24 hours. The binder was used in an amount of about 4 weight percent for each alloy composition. Then the ingot was crushed to fine particles by maintaining the ingot in a hydrogen gas atmosphere at about 30 atmospheric pressure in an 18-8 stainless steel high pressure proof container for about 24 hours. The fine particles were kneaded with an organic binder and molded in a magnetic field. Finally, the mixture was cured.

TABLE 8

The results are shown in Table 8. The performance of an alloy of $Nd_{15}Fe_{77}B_8$ prepared using a sintering method is presented for purposes of comparison.

| | hydrogen decrepitation | | | mechanical grinding (ball-mill) | |
|---|---|---|---|---|---|
| No. | Br (KG) | 1Hc (kOe) | (BH)max (MGOe) | 1Hc (kOe) | (BH)max (MGOe) |
| comp. | 6.0 | 1.5 | 3.0 | 0.8 | 1.2 |
| 1 | 6.7 | 2.2 | 5.1 | 0.7 | 1.2 |
| 2 | 8.6 | 8.9 | 17.4 | 1.3 | 1.8 |
| 3 | 7.1 | 6.9 | 10.5 | 1.2 | 1.6 |
| 4 | 6.2 | 5.0 | 6.1 | 1.0 | 1.4 |
| 5 | 4.8 | 1.2 | 1.3 | 0.7 | 0.8 |
| 6 | 8.4 | 5.1 | 13.8 | 1.4 | 1.8 |
| 7 | 5.0 | 1.4 | 1.2 | 0.6 | 0.7 |
| 8 | 8.7 | 8.0 | 16.6 | 1.8 | 2.0 |
| 9 | 8.7 | 10.5 | 17.8 | 1.7 | 2.1 |
| 10 | 8.8 | 9.5 | 17.1 | 1.0 | 1.4 |
| 11 | 8.6 | 10.9 | 16.4 | 1.5 | 2.0 |
| 12 | 8.9 | 10.0 | 17.3 | 1.4 | 1.9 |
| 13 | 7.2 | 6.7 | 10.8 | 1.0 | 1.5 |
| 14 | 8.0 | 6.8 | 12.8 | 1.3 | 1.8 |
| 15 | 8.8 | 9.7 | 16.0 | 1.6 | 1.8 |

EXAMPLE 5

This example shows the relationship between the strain rate of the sample during hot working and the resulting magnetic properties. Two representative alloys, $Pr_{15}Fe_{81}B_4$ and $Ce_3Pr_{10}Nd_{10}Fe_{73}B_4$, were melted in an induction furnace and cast into iron dies. Hot pressing was performed on the cast alloy ingots at varying speeds while the temperature was maintained at 1000° C. and the ratio of reduction at 80%. Annealing treatment was performed for 24 hours at 1000° C. after the hot pressing. The results are shown in Table 9.

TABLE 9

| strain rate | $Pr_{15}Fe_{81}B_4$ | | $Ce_3Pr_{10}Nd_{10}Fe_{73}B_4$ | |
|---|---|---|---|---|
| (/second) | iHc (KOe) | B r (KG) | iHc (KOe) | B r (KG) |
| $10^{-5}$~$10^{-4}$/s | 10.6 | 10.9 | 0.0 | 10.7 |
| $10^{-4}$~$10^{-3}$/s | 14.3 | 10.8 | 10.4 | 10.0 |
| $10^{-3}$~$10^{-2}$/s | 15.1 | 9.5 | 12.0 | 10.0 |
| $10^{-2}$~$10^{-1}$/s | 16.0 | 8.8 | 13.8 | 8.9 |
| $10^{-1}$~1/s | 16.0 | 7.0 | 15.0 | 7.1 |
| 1~10/s | X | X | 15.0 | 6.8 |
| 10~$10^2$/s | X | X | X | X |
| $10^2$~$10^3$/s | X | X | X | X |

X: the sample is cracked

Desirable strain rates are between about $10^{-4}$ and 1 per second. As can be seen in Table 9, the intrinsic coercivity decreases significantly when the strain rate is less than about $10^{-4}$ per second. The decrease in intrinsic coercivity is believed to be due to the fact that crystal grains grow rapidly as a result of heat and become bulky. On the other hand, productivity decreases and manufacturing costs increases when the strain rate is too large. When the strain rate is greater than about 1 per second some samples crack and cannot be manufactured.

EXAMPLE 6

Three alloy compositions, specifically $Pr_{17}Fe_{79}B_4Nd_{30}Fe_{55}B_{15}$ and $Ce_3Nd_{10}Pr_{10}Fe_{50}Co_{17}Zr_2B_8$, induction furnace and cast into iron dies. Hot working was performed by extrusion at varying temperatures as shown in Table 10. The extruded cast alloy was annealed for 24 hours at 1000° C. During extrusion, the strain rate was maintained between about $10^{-3}$ and $10^{-2}$ per second and the ratio of reduction was 80%. The relationship between manufacturing temperature, intrinsic coercivity and C axis orientation rate are shown in Table 10.

TABLE 10

| composition | property | plastic processing temperature (° C.) | | | | | | | | | | |
|---|---|---|---|---|---|---|---|---|---|---|---|---|
| | | room temperature | 250 | 500 | 700 | 800 | 900 | 950 | 1000 | 1050 | 1100 | 1150 |
| $Pr_{17}Fe_{79}B_4$ | iHc(KOe) | Δ | Δ | 10.8 | 11.8 | 10.6 | 8.4 | 9.0 | 8.6 | 7.8 | 6.2 | 2.1 |
| | C axis orientation rate | Δ | Δ | 82 | 80 | 85 | 85 | 95 | 96 | 97 | 95 | 70 |
| $Nd_{30}Fe_{55}B_{15}$ | iHc(KOe) | X | X | 15.0 | 13.6 | 12.6 | 12.0 | 12.4 | 9.2 | 5.8 | 1.5 | |
| | c axis orientation rate | X | X | 72 | 71 | 82 | 98 | 96 | 98 | 97 | 97 | 73 |
| $Ce_3Nd_{10}Pr_{10}Fe_{50}Co_{17}Zr_2B_8$ | iHc(KOe) | X | Δ | 20.0 | 19.0 | 14.4 | 16.8 | 14.2 | 17.2 | 15.6 | 11.4 | 2.5 |
| | C axis orientation rate | X | Δ | 63 | 75 | 81 | 89 | 96 | 95 | 97 | 95 | 69 |

X: the sample can not be manufactured
Δ: the sample is cracked and can not be measured The C axis orientation rate represents the rate in volume percent of the easy magnetization axis of the crystal grains and corresponds to the C axis of the permanent magnet. A larger rate represents a finer anisotropic magnet.

As can be seen in Table 10, when the manufacturing temperature was less than about 500° C. the sample cracked and could not be manufactured. However, excellent magnetic properties including a C axis orientation rate of 80% were obtained at temperatures of 500° C. or above. Preferably, the manufacturing temperature should be between about 800° and 1100° C. because the intrinsic coercivity decreases at temperatures of about 1100° C. An even more preferable manufacturing temperature range is between about 800° and 1050° C.

EXAMPLE 7

Alloys having the compositions indicated in Table 11 specifically $Pr_{17}Fe_{79}B_4$ and $Nd_{30}Fe_{55}B_{15}$ were melted and cast as described in Example 6. Hot working was performed by extrusion at a temperature of 1000° C. and the ratio of reduction was varied. Annealing treatment was performed for 24 hours at a temperature of 1000° C. The relationship between the ratio of reduction, intrinsic coercivity and C axis orientation rate are shown in Table 11.

TABLE 11

| | $Pr_{17}Fe_{79}B_4$ | | $Nd_{30}Fe_{55}B_{15}$ | |
|---|---|---|---|---|
| ratio of reduction (%) | iHc (KOe) | C axis orientation rate (%) | iHc (KOe) | C axis orientation rate (%) |
| 0 | 4.3 | 58 | 5.5 | 60 |
| 20 | 4.7 | 68 | 6.7 | 66 |
| 40 | 4.9 | 71 | 7.4 | 70 |
| 60 | 6.9 | 80 | 9.0 | 81 |
| 70 | 7.7 | 90 | 10.8 | 93 |
| 80 | 8.6 | 96 | 12.4 | 98 |
| 90 | 9.4 | 95 | 12.8 | 98 |

The strain rate was controlled between about $10^{-3}$ and $10^{-2}$ per second and it was determined that the C axis orientation rate was 80% or greater when the ratio of reduction was 60% or greater.

EXAMPLE 8

This Example shows the relationship between the strain rate of the sample during hot working and the resulting magnetic properties. The alloy compositions shown in Table 12 were melted and casted in a vacuum melting furnace. The cast ingots were placed in a stainless steel case and hot rolling was performed at varying strain rates while the temperature was maintained at 900° C. and the ratio of reduction at 80%. The results are shown in Table 13.

TABLE 12

| No. | Composition | | | | | |
|---|---|---|---|---|---|---|
| 1 | $Pr_{17}$ | $Fe_{78}$ | $B_5$ | | | |
| 2 | $Pr_{17}$ | $Fe_{75}$ | $B_5$ | $Cu_3$ | | |
| 3 | $Pr_{12}$ | $Nd_5$ | $Fe_{77}$ | $B_4$ | $Ni_2$ | |
| 4 | $Pr_{16}$ | $Fe_{73}$ | $Co_5$ | $B_5$ | Ga | |
| 5 | $Pr_{15}$ | $Fe_{70}$ | $Co_5$ | $B_5$ | $Cu_4$ | Al |

TABLE 13

| No. | Strain rate | $10^{-1}$–1/s | 1–10/s | 10–$10^2$/s | $10^2$–$10^3$/s |
|---|---|---|---|---|---|
| 1 | Br (KG) | 7.8 | 7.4 | *X | X |
| | iHC (KOe) | 16.0 | 16.5 | | |
| 2 | Br (KG) | 8.3 | 8.0 | 7.7 | X |
| | iHC (KOe) | 17.2 | 17.7 | 18.1 | |
| 3 | Br (KG) | 8.4 | 8.0 | 7.7 | X |
| | iHC (KOe) | 16.0 | 16.6 | 16.4 | |
| 4 | Br (KG) | 8.4 | 8.0 | 7.6 | X |
| | iHC (KOe) | 16.3 | 17.0 | 17.0 | |
| 5 | Br (KG) | 8.4 | 8.2 | 7.7 | 6.0 |
| | iHC (KOe) | 16.8 | 18.0 | 18.2 | 2.7 |

*X . . . sample can not be manufactured due to cracking

Desirable strain rates are between about $10^{-1}$ to $10^2$ per second. As can be seen from the results in Table 13, the intrinsic coercivity decreases significantly when the strain rate is greater than about $10^{-2}$ per second, and some samples crack and cannot be manufactured.

EXAMPLE 9

Two alloy compositions, specifically $Pr_{15}Dy_2Fe_{79}B_4$ and $Pr_{12}Nd_3Fe_{72}Co_5B_5Cu_3$, were melted and cast. The ingots were hot worked by extrusion at varying speeds while the temperature was maintained at 1000° C. and the ratio of reduction at 70%. Annealing treatment was performed for 10 hours at 900° C. after the extrusion. The results are shown in Table 14.

TABLE 14

| | $Pr_{15}Dy_2Fe_{78}B_4$ | | $Pr_{12Nd3}Fe_{72}Co_5B_5Cu_3$ | |
|---|---|---|---|---|
| Strain rate | iHc (KOe) | Br (KG) | iHc (KOe) | Br (KG) |
| $10^{-6}$~$10^{-5}$/s | 6.6 | 7.9 | 5.9 | 6.4 |
| $10^{-3}$~$10^{-2}$/s | 11.8 | 9.2 | 10.5 | 9.4 |
| $10^{-1}$~1/s | 15.5 | 8.8 | 14.2 | 9.0 |
| 1~10/s | 17.0 | 8.1 | 16.8 | 8.4 |
| 10~$10^2$/s | 19.3 | 7.5 | 18.3 | 7.8 |
| $10^2$~$10^3$/s | 5.0 | 6.0 | 7.1 | 6.0 |
| $10^3$~$10^4$/s | X | X | 2.1 | 4.0 |

*X . . . sample can not be manufactured

Desirable strain rates are between about $10^{-3}$ to $10^{-2}$ per second. As can be seen from the results in Table 14, intrinsic coercivity of greater than 10 KOe at a strain rate of from $10^{-3}$ to $10^{-2}$ per second was obtained. The intrinsic coercivity decreases significantly when the strain rate is less than about $10^{-3}$ per second. The decrease in intrinsic coercivity is believed to be due to the fact that crystal grains grow rapidly as a result of heat and become bulky. On the other hand productivity decreases and manufacturing costs increase when the strain rate is too large. When the strain rate is greater than about $10^{-3}$ per second some samples crack and cannot be manufactured.

EXAMPLE 10

Alloys having the compositions in Table 15 were melted in an induction furnace and cast into iron dyes. The ingots were cut out as a cube having a side 15 mm. Hot working was performed by hot pressing at a temperature of 1000° C. in an argon atmosphere to produce a plate having a thickness of 4 mm. The properties of the resulting magnets are shown in Table 16.

TABLE 15

| No. | Composition |
|---|---|
| 1 | $Pr_{17}Fe_{76.5}B_5Cu_{1.5}$ |
| 2 | $Pr_{14}Nd_3Fe_{76.5}B_5Cu_{1.5}$ |
| 3 | $Pr_{14}Ce_3Fe_{78.5}B_3Au_{1.5}$ |
| 4 | $Pr_{14}La_3Fe_{73.5}B_6Cu_{1.5}$ |
| 5 | $Pr_{14}Dy_3Fe_{66.5}Co_{10}B_5Cu_{1.5}$ |
| 6 | $Pr_{14}Tb_3Fe_{71}Co_5B_{5.5}Ag_{1.5}$ |
| 7 | $Pr_{14}Ho_3Fe_{76.5}B_5Cu_{1.5}$ |
| 8 | $Pr_{14}Y_3Fe_{76.5}B_5Cu_{1.5}$ |
| 9 | $Pr_{14}Nd_2Ce_1Fe_{76.5}B_5Cu_{1.5}$ |
| 10 | $Pr_{14}Nd_1Ce_1La_1Fe_{76.5}B_5Cu_{1.5}$ |
| 11 | $Pr_{14}Nd_1Ce_1Dy_1Fe_{76.5}B_5Cu_{1.5}$ |
| 12 | $Pr_9Nd_8Fe_{76.5}B_5Cu_{1.5}$ |
| 13 | $Pr_9Nd_4Ce_2Fe_{76.5}B_5Ag_{1.5}$ |
| 14 | $Pr_9Nd_6Dy_2Fe_{77.5}B_4Ag_{1.5}$ |
| 15 | $Pr_9Ce_8Fe_{76.5}B_5Au_{1.5}$ |
| 16 | $Pr_9Ce_4La_1Dy_3Fe_{75.5}B_6Cu_{1.5}$ |
| 17 | $Pr_9Nd_5Ce_2La_1Fe_{46.5}Co_{10}B_5Ag_{1.5}$ |
| 18 | $Pr_9Nd_6Ho_2Fe_{76.5}B_5Au_{1.5}$ |
| 19 | $Pr_9Nd_4Tb_3Fe_{76.5}B_5Cu_{1.5}$ |
| 20 | $Pr_9Nd_6Y_2Fe_{76.5}B_5Cu_{1.5}$ |
| 21 | $Pr_9Nd_5Dy_2Ce_1Fe_{72.5}Co_5B_4Cu_{1.5}$ |
| 22 | $Pr_4Nd_{13}Fe_{76.5}B_5Cu_{1.5}$ |
| 23 | $Pr_4Ce_4Nd_9Fe_{76.5}B_5Cu_{1.5}$ |
| 24 | $Pr_4Ce_4Nd_8La_1Fe_{76.5}B_5Au_{1.5}$ |
| 25 | $Pr_4Nd_{12}Dy_1Fe_{77.5}B_4Cu_{1.5}$ |
| 26 | $Pr_4Nd_{12}Tb_1Fe_{76.5}B_5Ag_{1.5}$ |
| 27 | $Pr_4Nd_{12}Ho_1Fe_{76.5}B_5Au_{1.5}$ |
| 28 | $Pr_4Ce_2Dy_2Nd_9Fe_{71.5}Co_5B_5Cu_{1.5}$ |
| 29 | $Pr_4Ce_2Dy_2La_1Nd_9Fe_{77.5}B_4Cu_{1.5}$ |
| 30 | $Pr_4Nd_{11}Y_8Fe_{76.5}B_5Cu_{1.5}$ |
| 31 | $Pr_2Nd_2Dy_2Ce_{11}Fe_{76.5}B_5Cu_{1.5}$ |
| 32 | $Nd_{17}Fe_{76.5}B_5Cu_{1.5}$ |
| 33 | $Nd_{15}Dy_2Fe_{76.5}B_5Ag_{1.5}$ |
| 34 | $Nd_{14}Pr_1Ce_2Fe_{76.5}B_5Cu_{1.5}$ |
| 35 | $Nd_{13}Pr_1Ce_2La_1Fe_{76.5}B_5Cu_{1.5}$ |
| 36 | $Nd_{15}Ce_2Fe_{76.5}B_5Cu_{1.5}$ |
| 37 | $Nd_{15}Pr_2Fe_{71.5}Co_5B_5Ag_{1.5}$ |
| 38 | $Nd_{15}La_2Fe_{76.5}B_5Cu_{1.5}$ |
| 39 | $Nd_{15}Tb_2Fe_{76.5}B_5Au_{1.5}$ |
| 40 | $Nd_{15}Ho_2Fe_{74.5}B_5Cu_{1.5}$ |
| 41 | $Nd_{14}Pr_2Dy_1Fe_{76.5}B_5Cu_{1.5}$ |
| 42 | $Pr_{14}Sm_3Fe_{76.5}B_5Cu_{1.5}$ |
| 43 | $Pr_{14}Eu_3Fe_{76.5}B_5Ag_{1.5}$ |
| 44 | $Pr_{14}Gd_3Fe_{76.5}B_5Au_{1.5}$ |
| 45 | $Pr_{14}Tm_3Fe_{76.5}B_5Cu_{1.5}$ |
| 46 | $Pr_{14}Yb_3Fe_{76.5}B_5Cu_{1.5}$ |
| 47 | $Pr_{14}Lu_3Fe_{76.5}B_5Cu_{1.5}$ |
| 48 | $Pr_{12}Sm_3Nd_2Fe_{76.5}B_5Cu_{1.5}$ |
| 49 | $Pr_{11}Sm_3Nd_2Ce_1Fe_{76.5}B_5Cu_{1.5}$ |
| 50 | $Pr_{10}Sm_3Nd_2Ce_1La_1Fe_{76.5}B_5Cu_{1.5}$ |
| 51 | $Pr_{12}Sm_3Ce_2Fe_{76.5}B_5Cu_{1.5}$ |

TABLE 16

| No. | $(BH)_{max}$(MGOe) | iHc(KOe) |
|---|---|---|
| 1 | 45.2 | 10.7 |
| 2 | 43.4 | 8.8 |
| 3 | 36.7 | 9.0 |
| 4 | 23.5 | 8.3 |
| 5 | 38.0 | 15.2 |
| 6 | 37.2 | 14.3 |
| 7 | 32.5 | 13.5 |
| 8 | 30.7 | 8.8 |
| 9 | 40.2 | 9.1 |
| 10 | 37.5 | 8.0 |
| 11 | 40.2 | 12.5 |
| 12 | 32.3 | 7.5 |

TABLE 16-continued

| No. | $(BH)_{max}$(MGOe) | iHc(KOe) |
|---|---|---|
| 13 | 27.5 | 7.0 |
| 14 | 25.0 | 12.5 |
| 15 | 20.0 | 6.2 |
| 16 | 11.5 | 7.5 |
| 17 | 23.2 | 8.5 |
| 18 | 20.7 | 9.0 |
| 19 | 23.2 | 9.3 |
| 20 | 17.2 | 6.8 |
| 21 | 22.1 | 10.5 |
| 22 | 25.2 | 7.5 |
| 23 | 18.2 | 6.7 |
| 24 | 17.5 | 6.8 |
| 25 | 20.5 | 9.2 |
| 26 | 19.0 | 9.6 |
| 27 | 15.0 | 8.0 |
| 28 | 14.2 | 7.5 |
| 29 | 14.0 | 6.5 |
| 30 | 23.0 | 6.0 |
| 31 | 8.0 | 4.0 |
| 32 | 12.5 | 4.8 |
| 33 | 10.0 | 5.4 |
| 34 | 10.7 | 5.0 |
| 35 | 8.4 | 4.3 |
| 36 | 8.0 | 4.0 |
| 37 | 9.4 | 4.6 |
| 38 | 7.5 | 3.8 |
| 39 | 6.5 | 5.0 |
| 40 | 6.9 | 5.3 |
| 41 | 12.5 | 6.0 |
| 42 | 37.5 | 8.0 |
| 43 | 34.5 | 6.5 |
| 44 | 33.2 | 8.7 |
| 45 | 30.2 | 6.8 |
| 46 | 31.5 | 7.2 |
| 47 | 30.9 | 6.7 |
| 48 | 35.0 | 7.0 |
| 49 | 32.7 | 6.8 |
| 50 | 30.8 | 6.0 |
| 51 | 30.0 | 6.1 |

As can be seen from the results set forth in Tables 15 and 16, the sample No. 1 has the highest intrinsic coercivity. However, good properties for practical use can be obtained by the composition wherein 80% and higher of rare earth element is Pr even if other rare earth elements are contained.

The permanent magnets prepared in accordance with the invention have sufficient coercivity which is achieved by hot working cast alloy ingots without pulverizing the ingot. Pulverization is ordinarily done prior to carrying out the sintering method of the prior art.

In addition, the hot working is carried out on cast magnetic alloys in a one-step process. This is unlike the two-step process used for hot working the samples obtained from quenched ribbon fragments. The use of a one-step hot working process increases in the intrinsic coercivity in addition to making the magnet anisotropic. Accordingly, the manufacturing process of the permanent magnet is greatly simplified compared to the sintering method or the resin-bonding technique used in quenched ribbon fragments shown in the prior art.

Furthermore, when the samples are pulverized or hydrogen decrepitated after hot working, anisotropic resin-bonded magnets can also be provided in accordance with the invention.

It will thus be seen that the objects set forth above, among those made apparent from the preceding description, are efficiently attained and, since certain changes may be made in carrying out the method and in the article set forth without departing from the spirit and scope of the invention, it is intended that all matter contained in the above description and shown in the accompanying drawings shall be interpreted as illustrative and not in a limited sense.

It is also to be understood that the following claims are intended to cover all of the generic and specific features of the invention herein described and all statements of the scope of the invention which, as a matter of language, might be said to fall therebetween.

What is claimed is:

1. A method for producing a permanent magnet having as principal constituents at least one rare earth metal, iron, boron and copper, comprising:

providing a magnet alloy composition including at least one rare earth metal, iron, boron and copper;

melting the magnet alloy composition including the rare earth metal, iron, boron and copper, casting the alloy composition into an ingot, hot working the alloy ingot at a temperature of at least about 500° C. with a strain rate of from about $10^{-4}$ to $10^{2}$ per second.

2. The method of claim 1, wherein the strain rate is from about $10^{-4}$ to 1 per second.

3. The method of claim 1, further including the step of heat-treating the cast alloy ingot at a temperature of at least 250° C.

4. The method of claim 3, wherein the heat-treating is carried out at temperatures between about 800° and 1050° C.

5. The method of claim 1, wherein the ratio of reduction of the alloy ingot during hot-working is at least about 60%, the ratio of reduction defined as $$\frac{d_1 - d_2}{d_1} \times 100,$$

wherein $d_1$ is a dimension before processing and $d_2$ is the dimension after processing.

6. The method of claim 1, wherein the hot-working step is extrusion.

7. The method of claim 1, wherein the hot-working step is rolling.

8. The method of claim 1, wherein the hot-working step is stamping.

9. The method of claim 1, wherein the hot-working step is die pressing.

10. The method of claim 1, further including the steps of:

pulverizing the hot worked ingot to provide a powder;

kneading the powder with an organic binder, and curing the kneaded powder and binder mixture to yield a resin-bonded magnet.

11. The method of claim 10, wherein the hot worked ingot is pulverized by hydrogen decrepitation.

12. The method of claim 1, wherein the strain rate is between $10^{-3}$ and $10^{-2}$ per second.

13. The method of claim 5, wherein the ratio of reduction is at least about 80%.

14. The method of claim 1, wherein the strain rate is between about $10^{-3}$ and $10^{-2}$ per second and the ratio of reduction is at least about 80%, the ratio defined as $$\frac{d_1 - d_2}{d_1} \times 100,$$

wherein $d_1$ is a dimension before processing and $d_2$ is the dimension after processing.

15. A method for producing a permanent magnet having as principal constituents at least one rare earth metal, iron, boron and copper, comprising:

melting a magnet alloy composition including a rare earth metal, iron, boron and copper, casting the alloy composition into an ingot, hot working the alloy ingot at a temperature of at least about 500° C. with a strain rate of from about $10^{-1}$ to $10^{2}$ per second.

16. A method for producing a permanent magnet having as principal constituents at least one rare earth metal, iron, boron and copper comprising:

melting a magnet alloy composition including a rare earth metal, iron, copper and boron, casting the alloy composition into an ingot, hot working the alloy ingot at a temperature of at least about 500° C. with a strain rate of from about $10^{-1}$ to $10^{2}$ per second and the ratio of reduction is at least about 80%, the ratio defined as $(d_1-d_2)/d_1\times100$, wherein $d_1$ is a dimension before processing and $d_2$ is the dimension after processing.

17. The method of claim 1, wherein the alloy composition is provided with up to about 6% copper.

18. The method of claim 1, wherein the alloy composition is provided with about 0.1 to 6% copper.

19. The method of claim 1, wherein the alloy composition is provided with about 1.5 to 4% copper.

20.The method of claim 1, wherein the alloy composition is provided with about 0.1 to 3% copper.

21. The method of claim 1, wherein the alloy composition is provided with about 1.5% copper.

22. The method of claim 1, wherein the alloy composition is provided with a bout 3% copper.

23. The method of claim 1, wherein the alloy composition is provided with about 4% copper.

24. The permanent magnet formed by the method of claim 1.

* * * * *